US011769476B2

(12) United States Patent
Goelsdorf

(10) Patent No.: US 11,769,476 B2
(45) Date of Patent: Sep. 26, 2023

(54) WALL HANGER FOR MUSICAL INSTRUMENT

(71) Applicant: GÖLDO MUSIC GMBH, Hannover (DE)

(72) Inventor: Dieter Goelsdorf, Madrid (ES)

(73) Assignee: GOELDO MUSIC GMBH, Hannover (DE)

( * ) Notice: Subject to any disclaimer, the term of this patent is extended or adjusted under 35 U.S.C. 154(b) by 135 days.

(21) Appl. No.: 17/427,701

(22) PCT Filed: Jan. 31, 2020

(86) PCT No.: PCT/EP2020/052498

§ 371 (c)(1),
(2) Date: Aug. 3, 2021

(87) PCT Pub. No.: WO2020/161023

PCT Pub. Date: Aug. 13, 2020

(65) Prior Publication Data

US 2022/0130358 A1 Apr. 28, 2022

(30) Foreign Application Priority Data

Feb. 4, 2019 (DE) ..... 20 2019 100 644.7

(51) Int. Cl.
*G10G 5/00* (2006.01)
*G10D 3/00* (2020.01)

(52) U.S. Cl.
CPC ..... *G10G 5/00* (2013.01); *G10D 3/00* (2013.01)

(58) Field of Classification Search
CPC ..... G10G 5/00; G10D 3/00
See application file for complete search history.

(56) References Cited

U.S. PATENT DOCUMENTS

| | | | | |
|---|---|---|---|---|
| 6,127,612 | A * | 10/2000 | Yu | G10G 5/00 84/421 |
| 7,105,732 | B1 | 9/2006 | Hsieh | |
| 8,490,942 | B1 | 7/2013 | Henry | |
| 2007/0125222 | A1* | 6/2007 | Clifford | G10G 5/00 84/327 |
| 2014/0117173 | A1* | 5/2014 | Liaw | G10G 5/00 248/125.8 |
| 2016/0104470 | A1 | 4/2016 | Hennessey | |

FOREIGN PATENT DOCUMENTS

CN 205564263 A 9/2016

* cited by examiner

*Primary Examiner* — Kimberly R Lockett
(74) *Attorney, Agent, or Firm* — Andrew Wilford

(57) ABSTRACT

The invention relates to a bracket and, in particular, a wall bracket for a musical instrument (1), particularly for a stringed instrument. To this end, the bracket has an adjustable base (4) for receiving an instrument body (1*a*) and at least two retaining arms (5), which are able to pivot relative to an anchor element (3), for detachably securing an instrument neck (1*b*) received between the retaining arms (5). The base (4) and the two retaining arms (5) are coupled to each other by at least one connecting member (6). Furthermore, at least one spring (7) is provided which prestresses the base (4) into a rest position and the two retaining arms (5) into an open position. According to the invention, the connecting member (6) is designed as a connecting rod (6) rigidly coupling the base (4) to the two retaining arms (5) and prestressed by the spring (7).

18 Claims, 4 Drawing Sheets

WALL HANGER FOR MUSICAL INSTRUMENT

CROSS REFERENCE TO RELATED APPLICATIONS

This application is the US-national stage of PCT application PCT/EP2020/052498 filed 31 Jan. 2020 and claiming the priority of German patent application 202019100644.7 itself filed 4 Feb. 2019.

The invention relates to a mount and in particular a wall hanger for a musical instrument, in particular a stringed instrument, having an adjustable lower cradle for receiving an instrument body, and having at least two holding arms that can be pivoted relative to a mounting element for detachably securing an instrument held between the holding arms, the lower cradle and the two holding arms being coupled to one another via at least one connecting element, and at least one spring being prestressed to urge the lower cradle into a rest position and the two holding arms into an open position.

Such a mount is as a rule designed as a wall hanger or also a floor stand. If a wall hanger is used, its mounting element is regularly fastened to a wall. In the case of a floor stand, a frame that can be set on a floor is typically used as the mounting element. In principle, the mounting element can also be connected to a stand. In any case, the mounting element as a whole functions as an anchor for the two holding arms that can be pivoted relative to it. The lower cradle can also be adjusted relative to the mounting element between a rest position in the unloaded position and a working position in the loaded position.

In the rest position of the lower cradle, the two holding arms are located in their open position. As a result, the musical instrument to be held can be placed on the lower cradle. As a result of the weight of the musical instrument, the lower cradle moves from its rest position into the working position and at the same time, the two holding arms are pivoted from their open or spread position into a closed position. All this is done against the force of the spring.

A mounting and, in particular, wall hanger of the above-described construction is described in CN 205564263. In fact, here the instrument body is set down on supports. As a result, the two supports move away from each other against the force of a spring. Two upper holding arms close and ensure that an instrument neck is detachably secured. The two articulated arms are connected to the holding arms via cables, in particular Bowden cables.

In addition, a guide is provided that surrounds the above-mentioned spring. Within the guide, the two articulated arms are adjustable at the end. The other ends of the two articulated arms are case coupled to each other. As a result, an overall relatively complex mechanical construction is observed that by the rear grip on the guide for the articulated arms, on the one hand, and the Bowden cables between the articulated arms and the holding arms, on the other hand, tends to malfunction or can deform. This is because a guide inserted at this point can, for example, become fouled, so that the possibility of maladjustment and thus operability is impaired.

A comparable mount for a musical instrument is described in U.S. Pat. No. 8,490,942. In this case as well, pivotable holding arms are provided for detachably securing an instrument neck. The two holding arms can be pivoted with respect to an mounting element that is connected to a foot or floor stand or represents a component of such a floor stand.

When the instrument body is set into the lower cradle, the instrument body performs a pivoting movement.

The pivoting movement of the lower cradle is transmitted via an adjusting rod to an L-shaped lever. The pivoting movement of this lever caused by the adjusting rod, in turn, ensures that the two holding arms can be opened and closed in order to secure the instrument neck against the force of a spring. In this case, too, a complex mechanism is described that is susceptible to malfunction in the event of contamination and that can have a tendency to malfunction or tend to malfunction. This is because the movement of the lower cradle is deflected several times, which can lead to malfunctions in the event of impairments due to, for example, dust in the pivots. The invention is aimed at providing an overall remedy here.

The object of the invention is to further develop such a mount and, in particular, a wall hanger for a musical instrument in such a way that the operability is improved, specifically taking into account a simplified mechanical design.

In order to attain this object, a mount of the generic type and in particular a wall hanger for a musical instrument is characterized in that the connecting member is formed between the lower cradle and the two holding arms as a connecting rod that couples the lower cradle directly to the two holding arms and is prestressed by the spring.

As a rule, the connecting rod is fixed or firmly connected to the lower cradle. In contrast, advantageously, the connecting rod and the two holding arms are mostly coupled to one another via a common pivot. For this purpose, the pivot is typically provided at an upper end of the connecting rod. In addition, the invention is generally such that the lower cradle and the two holding arms define a common movement plane in the course of their respective adjusting movements. Furthermore, the connecting rod is moved in this movement plane. In this way, a particularly compact and mechanically simple construction is realized that, in contrast to the prior art, dispenses with complicated guides, steering levers, and the like.

Rather, the invention typically relies on only a single pivot, namely a common pivot, that couples the connecting rod or the rigid connecting member and the two holding arms to one another. Furthermore, since the two holding arms and the lower cradle perform their respective adjusting movements in a common adjusting plane, complicated deflections of the adjusting movement are unnecessary. As a result, not only is the mechanical structure simplified, but in particular also the operability is increased because Bowden cables, angle levers, adjusting rods, etc. can be dispensed with as in the prior art according to U.S. Pat. No. 8,490,942 or also in accordance with CN 205564263. The essential advantages are to be seen herein.

According to an advantageous embodiment, the holding arms and/or the lower cradle are designed to be adjustable at least transversely to the longitudinal extension of the connecting rod. As a result, different instrument sizes can be taken into account without problems. In the control case, at least the connecting rod is designed such that it can be telescoped. This applies in particular to the case in which guitars or generally stringed instruments of different sizes are to be detachably secured with the aid of the mount according to the invention.

In general, the two holding arms are each pivotably connected to the mounting element via at least one pivot. The mounting element in turn is coupled to a floor frame or is designed as a component of such a floor frame. The mount according to the invention is then designed as a lower cradle stand for receiving musical instruments. In the control case, however, the mounting element is fixed to a wall. In this case, the mount according to the invention is designed as a wall hanger for the relevant musical instrument.

A design that is simple in terms of construction and function is observed in that the two holding arms are designed as retaining plates that move in the actuating plane. In fact, the two retaining plates can be moved back and forth, for example, transversely to the longitudinal extension of the connecting rod. In this case, the holding plates are pivoted like scissors. In addition, it is possible for the holding plates each to be pivoted in the adjustment plane relative to the longitudinally extended connecting rod on an arc of a circle. In any case, the retaining plates have at least one projecting retaining finger that serves to detachably secure the instrument neck of the musical instrument to be held.

In order to be able to exclude any damage to the instrument neck from the outset at this point, the retaining fingers are substantially perpendicular to the retaining plate and optionally curved inwards. In addition, each retaining finger has at least one soft elastic surface. This can be realized in that plastic is applied to the holding finger or a hose made of plastic is pulled over the holding finger.

In any case, the movement of the two holding arms or of the movable holding plates or also of the scissor legs in the adjustment plane during the transition from the open position of the holding arms into their closed position and vice versa leads to the instrument neck of the musical instrument being secured in the closed position and being released for removal in the open position. Control of the holding arms is carried out by gravity by setting the instrument with its instrument body on the lower cradle. As a result, the lower cradle moves from its rest position down into the working position.

The associated adjusting movement of the lower cradle in the adjustment plane leads to the rigid connecting rod connected to the lower cradle acting on the holding arms via its upper-end pivot in that the holding arms shift from their open position assumed in the rest position of the lower cradle into the closed position as soon as the lower cradle assumes its working position due to the weight of the inserted musical instrument.

For proper mounting of the instrument body on the lower cradle, the invention recommends that the lower cradle be equipped with at least two support fingers. The support fingers extend normally at an angle to the adjustment plane in order to provide a sufficiently large support surface for the instrument body.

As in the case of the holding fingers as components of the holding arms, the two support finger also advantageously have a soft elastic surface in order to avoid damage to the surface of the instrument body. In this case, the procedure described above can be followed in such a way that the two supporting fingers are each equipped with the soft-elastic plastic coating on their surface, or a corresponding plastic hose is drawn over the relevant supporting finger and secured in a gripping manner. In any case, the soft elastic surface of the two support fingers additionally ensures that, when the musical instrument is placed on the lower cradle, not only damage is avoided, but this process is also carried out virtually noiselessly.

The spring that pretensions the lower cradle in its rest position and the two holding arms in the open position and that as a rule is compressed during the transition of the lower cradle into the working position and the two holding arms into the closed position, generally follows the longitudinal extent of the connecting rod. That is, the spring mostly extends parallel to the rigid connecting rod. As a result, the spring also experiences an arrangement in the common adjusting plane. As a result, the mount according to the invention particularly narrow because virtually all the functional elements move in the actuating plane or actually lie in the actuating plane. Except for this, only the holding fingers on the holding arms and also the supporting fingers of the lower cradle are removed. As a result, the required installation space for the mount according to the invention is small and can be accommodated and shipped, for example, in a package of small size.

The spring is typically a helical coil spring, although other springs may be used for this purpose. In principle, the rear handle is also conceivable for a plurality of springs. In addition, it is recommended that the spring surrounds the connecting rod and/or is connected to the connecting rod in its longitudinal extent or follows the longitudinal extension. In both cases, this design supports the compact design. If the spring is connected longitudinally to the connecting rod, this takes place advantageously at an upper end. That is, the spring is coupled to the top of the connecting rod.

In addition, it has proven useful if the spring is connected, on the one hand, to the connecting rod and, on the other hand, to the mounting element or is supported with respect to the mounting element. In this way, movements of the connecting rod directly result in the spring, on the one hand, prestressing the lower cradle in the rest position and the two flat arms in the open position and, on the other hand, being compressed into the closed position during the transition of the lower cradle into the working position and in the correct sequence of the two flat arms.

Conversely, the procedure can be reversed. In this case, the spring is compressed as it were in the rest position of the lower cradle and is stretched into the closed position during the transition of the lower cradle into the working position and in the correct sequence of the two hanger arms. In both cases, the spring provides the desired bias of the lower cradle in the rest position and the two flipper arms in the open position.

The entire hanger according to the invention is regularly produced from metal profiles or metal plates in order to enable a particularly stable design with a long service life. In this connection, virtually all conceivable metals, such as, for example, copper, brass, steel, stainless steel, etc. can be used with and without coating. Of course, it is also conceivable for optical reasons to coat the metals as well as a coating with, for example, plastic. In principle, however, the individual parts of the hanger according to the invention can also be produced from plastic, wood or other materials. Mixed forms are also conceivable.

As a result, a mount and, in particular, wall hanger for a musical instrument is provided that is produced by a strikingly simple mechanical construction and few functional elements, and with low manufacturing costs, minimal weight and high functionality. As a result, the hanger is not only certain to provide comprehensive and long-term use, but is also designed to be particularly advantageous with regard to shipping.

In this connection, a particularly small structural volume also plays a special role here, which is substantially restricted to the adjustment plane as described.

In the following, the invention is described in more detail with reference to a drawing showing a single embodiment. Therein:

FIGS. 5 and 6 show a further second and third embodiment variant of the invention.

Figure 1:
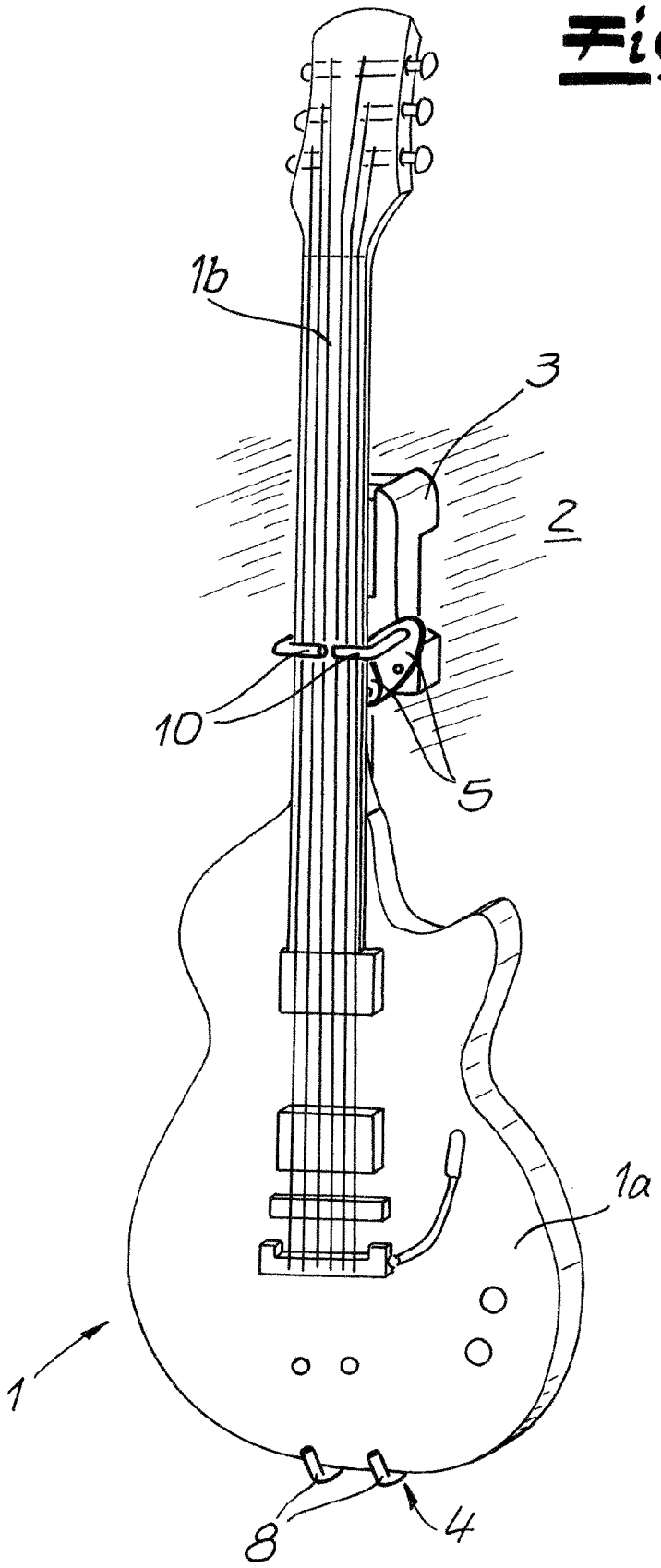
FIG. 1 shows the hanger according to the invention in the form of a wall hanger in an overview with a musical instrument.

The figures show a mount for a musical instrument 1 designed and provided in the embodiment and not by way of limitation as a wall hanger for fixing to a wall 2. In principle, the mount could also be designed as part of a floor stand. In this case, a mounting element 3 is not fastened to the wall 2, but rather to a lower cradle frame or is designed as part of this lower cradle frame.

In its basic construction, the mount according to the invention has, in addition to the above-mentioned mounting element 3, an adjustable lower cradle 4 constructed and designed to hold a body 1*a* of the musical instrument 1. In fact, the musical instrument 1 is a guitar and in particular an electric guitar in the context of the nonlimiting embodiment. The latter has, in addition to the instrument body 1*a*, basically and additionally an instrument neck 1*b*, which is also releasably secured with the aid of the mount.

For this purpose, at least two holding arms 5 are provided that are pivotable on the mounting element 3 and serve for releasably embracing and securing the instrument neck 1*b* of the musical instrument 1. The lower cradle 4 and the two holding arms 5 are coupled to one another via at least one connecting member 6. In addition, a spring 7 is provided.

Figure 4:
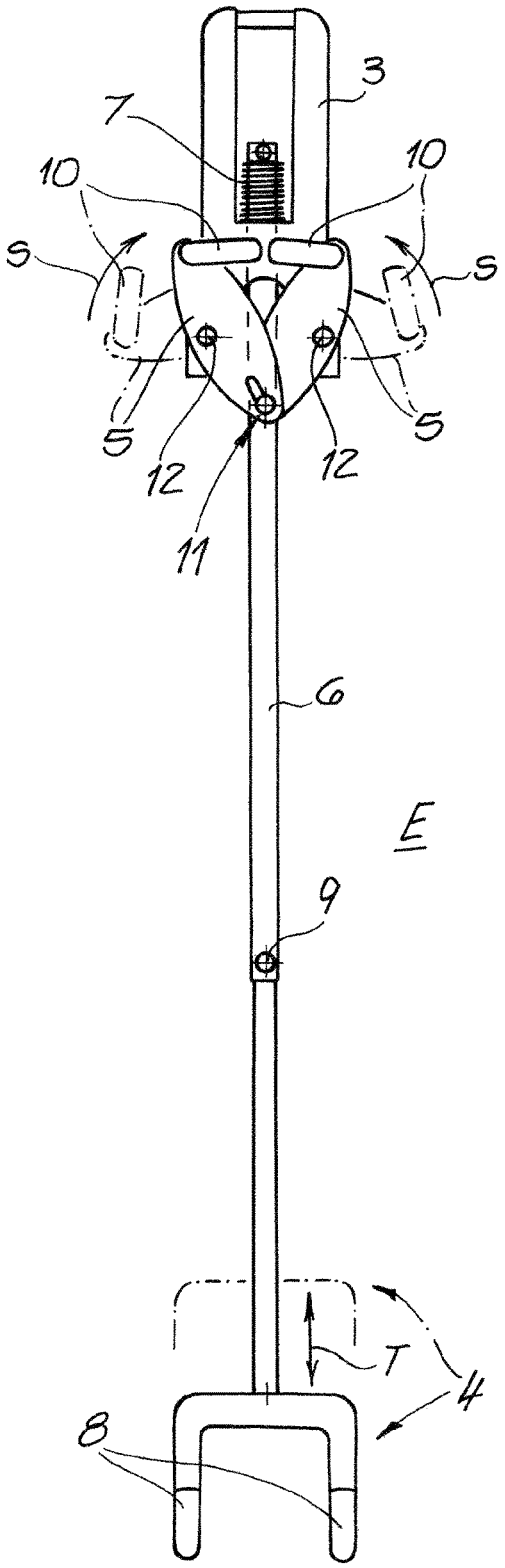
FIG. 4 shows the object according to FIG. 2 when moving from the open position into the closed position.

The design is such that the spring 7 pretensions the lower cradle 4 into an upper rest position shown in dot-dash lines in FIG. 4. The two holding arms 5 are biased by the spring 7 in an open position also shown in dot-dash lines in FIG. 4.

Figure 2:
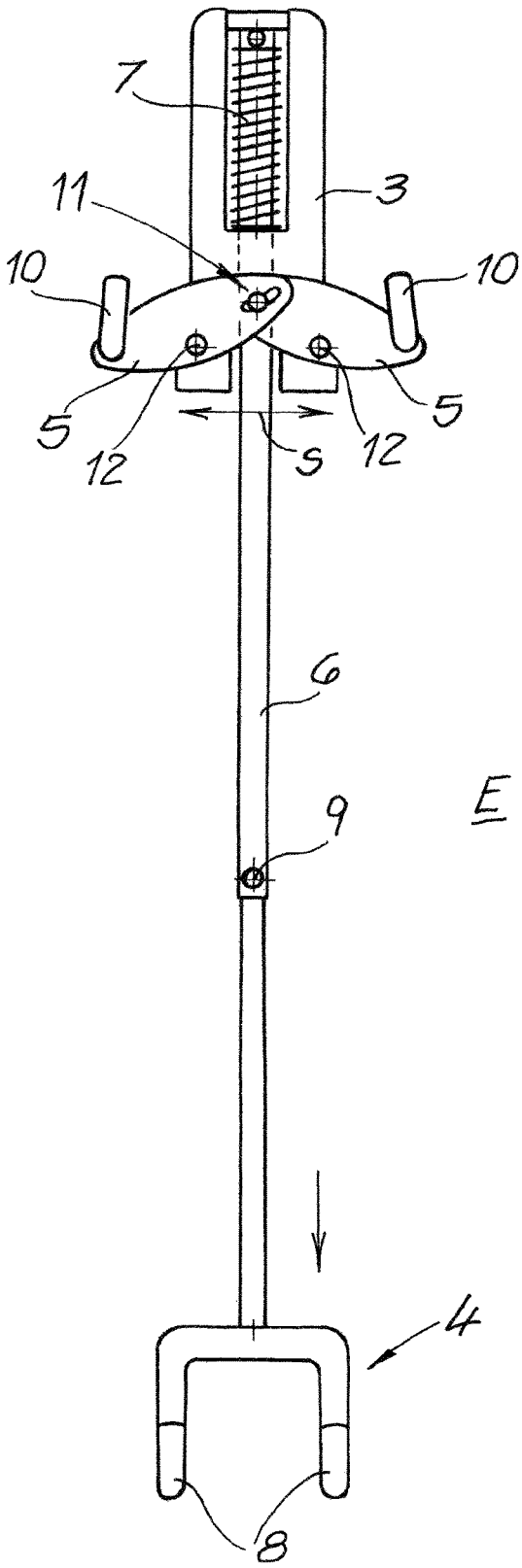
FIG. 2 is a front view of the object according to FIG. 1 without the musical instrument and in the open position.
Figure 3:
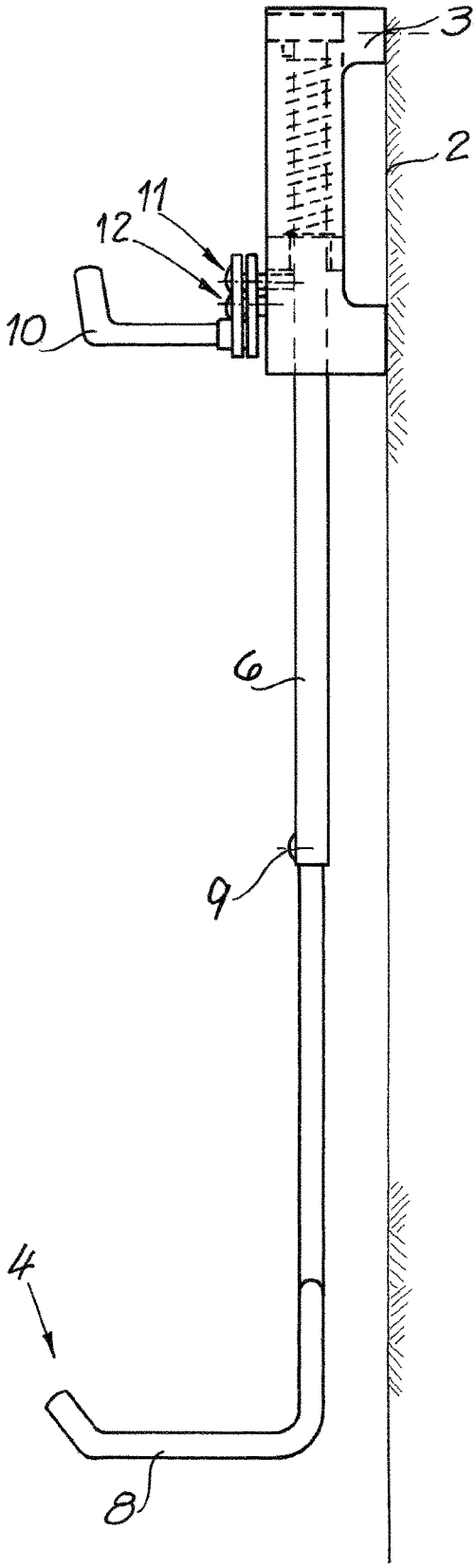
FIG. 3 is a side view of the hanger of FIGS. 1 and 2.

In the rest position of the lower cradle 4 and the open position of the two holding arms 5 in accordance with the dot-dashed illustration in FIG. 4 or in the open position illustrated in FIG. 2, the musical instrument 1 can be set upon the lower cradle 4. For this purpose, the instrument body 1*a* is set down on at least two supporting fingers 8 of the lower cradle 4 that, in the embodiment according to FIGS. 1 to 5 are integral parts of a U-shaped bracket fixed at the lower end of the connecting member 6. As soon as the musical instrument 1 is deposited with its instrument body 1 on the support fingers 8 or lower cradle 4, the weight of the musical instrument 1 ensures that the spring 7 is compressed. This can be seen in the transition from the position of FIG. 2 to that of FIG. 4

Figure 5:
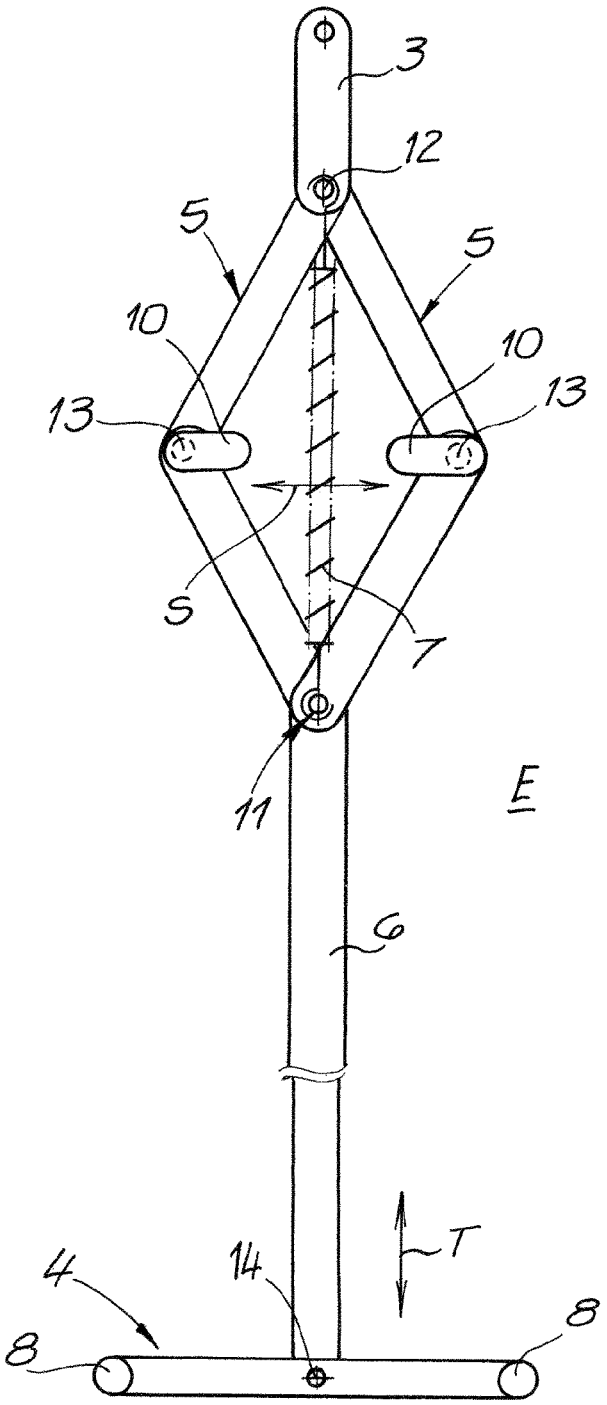
FIG. 5 shows a variant of the invention.

In the embodiment according to FIGS. 1 to 4, compression of the spring 7 is accompanied by an adjusting movement T of the lower cradle 4, shown in FIG. 4 by a double arrow and effected during the transition of the lower cradle 4 from the upper rest position shown in dash-dotted lines into the lower working position shown in solid lines. As a result of this adjusting movement T of the lower cradle 4, the two holding arms 5 are also pivoted starting from their open position in FIG. 2 also shown in a dot-dash representation in FIG. 4 into its closed position shown in solid lines in FIG. 4. This is accompanied by a further pivotal adjusting movement S of the holding arms 5 which, in the embodiment according to FIGS. 1 to 4, corresponds to an arc S indicated in FIG. 4 or to a transverse movement in comparison with the longitudinal movement and extent of the connecting member 6, as shown in FIGS. 2 and 5. As a result, the neck 1*b* of the musical instrument 1 is secured in the closed position of the holding arms 5 shown in solid lines in FIG. 4 until the musical instrument 1 with its instrument body 1*a* is again lifted off the lower cradle 4. This is because the holding arms 5 then shift from their closed position shown in solid lines in FIG. 4 into the open position shown there in dot-dash lines and also in FIG. 2.

According to the invention, the connecting member 6 is now designed as a connecting rod 6 that directly couples the lower cradle 4 to the two holding arms 5 and is prestressed with the aid of the spring 7. In fact, the connecting rod 6 is designed to be telescopic, so that different sizes of the musical instrument 1 to be received can be taken into account. In the embodiment shown in FIGS. 1 and 2, the telescopic capability provides for movement which is shown in FIGS. 1 and 2 to 4, and a fixing means 9 can fix how far an extension rod can dip into a dip tube to relatively fix both components of the connecting rod 6 in a desired position.

According to the invention, the lower cradle 4 and the two holding arms 5 perform the adjusting movement T of the lower cradle 4 longitudinally and parallel to the connecting rod 6 on the one hand and the arcuate and transverse pivoting movement S in comparison with the connecting rod 6 for the holding arms 5 on the other hand. Both adjusting movements S, T together define a common adjusting plane E in which the connecting rod 6 is also moved.

Consequently and essentially, the mounting element 3, the spring 7, the two holding arms 5 and also the lower cradle 4 lie in this common adjustment plane E, which leads to a particularly compact and narrow construction of the mount according to the invention. The projecting support fingers 8 of the lower cradle 4, on the one hand, and also holding fingers 10, also projecting with respect to the holding arms 5, on the other hand, are only excluded from this. In fact, the supporting fingers 8 and the holding fingers 10 are predominantly oriented in such a way that they largely project perpendicular to the lower cradle 4 or the holding arms 5 and thus of the adjusting plane E in accordance with the embodiment from the drawing plane in the direction of the viewer.

In order to avoid damage to the instrument body 1*a* as well as the instrument neck 1*b*, both the two support finger 8 and the two holding fingers 10 are each equipped with a soft elastic surface, as has already been described in detail above. The lower cradle 4 is rigidly connected to the lower end of the connecting rod 6. At its upper end, the connecting rod 6 is coupled to the two holding arms 5 via a common rod pivot 11. According to the embodiment, the pivot 11 is formed in such a way that a pivot pin connected to the connecting rod 6 engages in respective guide slots on the holding arms 5. As soon as the connecting rod 6 is moved downward during movement of the lower cradle 4 from its rest position into the working position according to the embodiment, as is the case shown in FIG. 2, the pivot pin follows the downward movement and ensures that, according to the embodiment, the two holding arms 5 perform the arcuate pivoting movement already described, on the one hand, in the clockwise direction indicated in FIG. 4 and, on the other hand, in the counterclockwise direction. As a result, the two holding fingers 10 connected to the holding arms 5 move toward one another and can wrap around the instrument neck 1*b* between them. The pivoting movement of the two holding arms 5 stops as soon as the holding fingers 10 rest on the outside of the instrument neck 1*b*.

In addition to the rod pivot 11 provided at an upper end on the connecting rod 6, the two holding arms 5 are each pivotably connected to the mounting element 3 via at least one further side pivot 12. This further pivot 12 ensures the rotary pivoting movement of the relevant holding arm 5 in the clockwise direction or counterclockwise as seen in the transition from the open position of the holding arms 5 shown by dot-and-dash lines in FIG. 4 to the closed position of the holding arms 5 shown in solid lines in FIG. 4. The two holding arms 5 are holding plates movable in the adjustment plane E as part of the embodiment according to FIGS. 1 to 4. In the variant according to FIG. 5 the two holding arms 5 are interconnected like scissor blades that are in turn connected via the head-side pivot 11 on the one hand to the connecting rod 6 and, on the other hand, via in this case a pivot 12, find a connection to the mounting element 3. The two scissor levers in this case have an additional central scissor-type pivot 13. The two holding fingers 10 are connected at these center pivots 13 to the holding arms 5 or the scissor legs are connected in the example case of FIG. 5.

As already explained, the holding fingers 10 are essentially perpendicular to the respective support arms 5. In addition, the holding fingers 10 are advantageously curved inward in order to be able to fit perfectly around the instrument neck 1*b*. The spring 7 follows the longitudinal extension of the connecting rod 6. In both embodiments, the spring 7 is a helical coil spring. In principle, it is, of course, also possible to use a differently loaded spring.

In the context of the variant according to FIGS. 1 to 4, the spring 7 is designed as a helical coil spring surrounding the connecting rod 6. In contrast, in the variant according to FIG. 5, the spring 7 is connected to the a longitudinal upward extension of the connecting rod 6. In both cases, the spring 7 is connected by its one end to the connecting rod 6 and by its other end to the mounting element 3 or is braced against the support element 3. As a result, of this pretensioning, the spring 7 ensures that the lower cradle 4 is shifted into its rest position and the two holding arms 5 are into their open positions as long as no musical instrument 1 is being held or supported.

However, if the musical instrument 1 is deposited with its instrument body 1*a* on the lower cradle 4, its weight therewith ensures that the spring 7 in the embodiment according to FIGS. 1 to 4 is compressed or, in the variant according to FIG. 5, is tensioned. This is because in this process, starting from the rest position, the lower cradle 4 performs the adjusting movement T, which, according to the embodiment, corresponds to the arrow in FIG. 2 and is coupled to a downward movement of the lower cradle 4 and consequently the connecting rod 6 connected thereto.

The downwardly moved connecting rod 6 in turn provides, via the upper pivot 11 and the holding arms 5 connected thereto, that the holding arms 5 also transition from their previously assumed spread position as shown in FIG. 2 into the closed position against the force of the spring 7. At the same time, the spring 7 in the variant according to FIGS. 1 to 4, to be precise until the two holding fingers 10 projecting on the holding arms 5 properly secure the instrument neck 1*b*. In the variant according to FIG. 5, the spring 7, which is extended during this process, again ensures that the instrument neck 1*b* is held firmly and releasably in this case.

In an unillustrated embodiment, the holding arms 5 are adjustable transversely of the longitudinal extension of the connecting rod 6. In this way, the holding arms 5 or the spacing of the holding fingers 10 can be adapted to differently designed instrument necks 1*b*. In the simplest case, it is conceivable, for this purpose, for the holding arms 5 to be designed in two parts and telescopically similar to the telescopic connecting rod 6. In the variant according to FIG. 5, it is conceivable that the holding fingers 10 can be displaced relative to the scissor-type pivot 13 in the transverse direction in comparison to the longitudinal extension of the connecting rod 6 in order to be able to make the adaptations described.

In addition to the basic possibility of being able to adjust the two holding arms 5 and thereby to be able to adapt them to different instrument necks 1*b*, the invention additionally provides the option of forming additionally or alternatively also the lower cradle 4 in an adjustable manner. This can be done by virtue of the fact that the two support fingers 8 connected to the lower cradle 4 are designed to be variable with regard to their relative spacing. In addition, however, the lower cradle 4 can also be rotated or pivoted as a whole about an axis 14 as shown in FIG. 5. A also multi-part design of the lower cradle 4 with two arms pivotably connected to the axle 14 with end-mounted support fingers 8 is also conceivable. In this way, the lower cradle 4 can be adapted, for example, to differently and in particular asymmetrically configured shapes of the instrument body 1*a*.

Figure 6A:
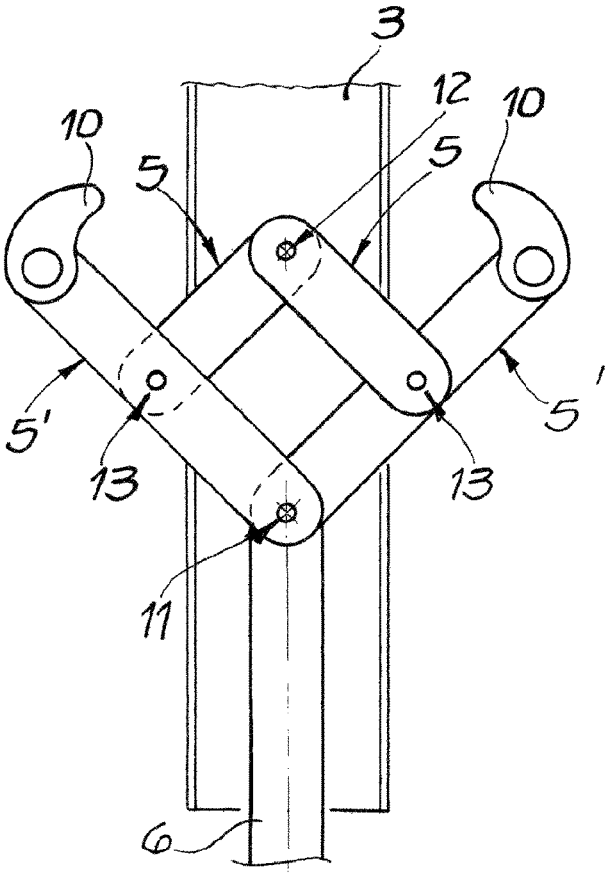
Figure 6B:
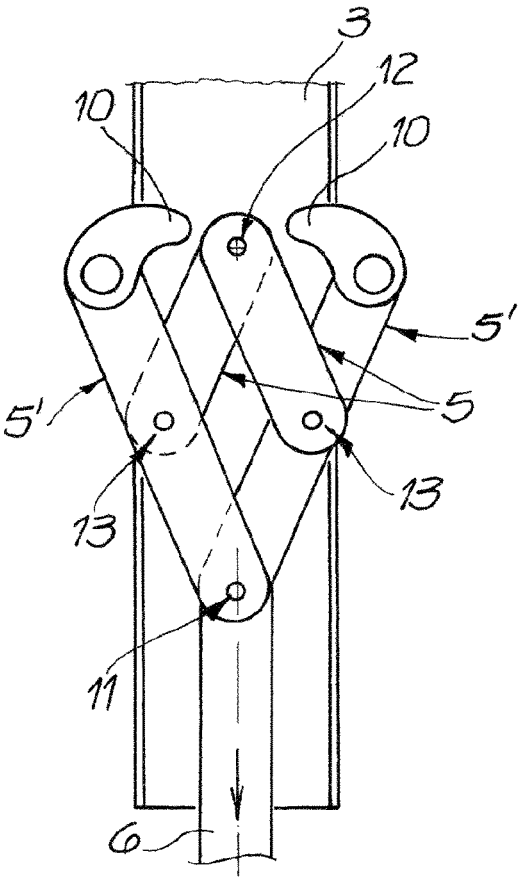

A slightly modified embodiment variant of the example according to FIG. 5 is shown in FIG. 6. In this case, the two holding arms 5 can also be adjusted transversely to the longitudinal extension of the connecting rod 6. As a result, the holding arms 5 or, in this connection, extensions 5' of the holding arms 5 and with them the holding fingers 10 can be adapted to differently designed instrument necks 1*b*. For this purpose, in the embodiment according to FIGS. 6A and 6B the holding fingers 10 are attached to the upper ends of the respective extensions 5' or the holding arms 5.

It can be seen that the extensions 5' each project from the upper end of the respective the holding arms 5 connected in turn to the telescopic connecting rod 6. Again, in this case, a scissor-type pivot 13 is realized that ensures displacement of the holding fingers 10 in the transverse direction in comparison to the longitudinal extension of the connecting rod 6, as can be seen when comparing the opened position according to FIG. 6A with the closed position of FIG. 5B embracing the guitar or instrument neck 1*b* as shown in FIG. 6B. The spring 7, which is also realized in the embodiment variant according to FIGS. 6A and 6B, is not explicitly illustrated here, but rather may be concealed behind the mounting element 3 and, in the illustration according to FIG. 6A, is shown by way of example, so that the two holding arms 5 in the position according to FIG. 6B can secure the instrument neck 1*b* as described with the spring force.

The invention claimed is:

1. A mount for a musical instrument, the mount comprising:

an adjustable lower cradle for receiving a body of the instrument;

a mounting element:

two holding arms pivotable relative to the mounting element and designed as holding plates or scissor arms that can be moved in the plane and each have at least one projecting holding finger for detachably securing an instrument neck received between the holding arms;

a connecting member fixed to the lower cradle and directly coupled to the two holding arms, the lower cradle and the two holding arms move in a common actuating plane in which the connecting member also moves; and a spring braced between the mounting element and the connecting member and urging the lower cradle into a rest position and the two holding arms into an open position.

2. The mount according to claim 1, wherein the connecting member is a rod and the two holding arms are coupled to one another via a common pivot.

3. The mount according to claim 2, wherein the pivot is provided at an upper end of the rod.

4. A mount for a musical instrument the mount comprising:

an adjustable lower cradle for receiving a body of the instrument;

a mounting element:

two holding arms pivotable relative to the mounting element, designed as holding plates or scissor arms that can be moved in the plane, each having at least one projecting holding finger, and connected pivotably to the mounting element via respective pivots for detachably securing an instrument neck received between the holding arms;

a connecting member fixed to the lower cradle and directly coupled to the two holding arms; and a spring braced between the mounting element and the connecting member and urging the lower cradle into a rest position and the two holding arms into an open position.

5. The holding device according to claim 1, wherein the respective holding fingers each extend substantially perpendicularly from the respective holding arm and are curved inward toward each other.

6. The mount according to claim 1, wherein each holding finger has a soft-elastic surface.

7. The mount according to claim 1, wherein the lower cradle has at least two support fingers.

8. The mount according to claim 7, wherein the two support fingers each have a soft elastic surface.

9. The mount according to claim 1, wherein the spring extends generally parallel to the connecting member.

10. The mount according to characterized claim 1, wherein the spring is a helical coil spring.

11. The mount according to claim 1, wherein the spring surrounds the connecting member and/or is longitudinally connected thereto.

12. The mount according to claim 1, wherein the two holding arms and/or the lower cradle are adjustable at least transversely to the longitudinal extent of the connecting member.

13. The mount as claimed in claim 12, wherein the connecting rod member telescopes.

14. A wall or floor mount for a stringed instrument having a body and a neck, the mount comprising:

a fixed mounting element;

a generally vertical elongated rod vertically guided in or on the element, shiftable between an upper rest position and a lower working position, and having a lower end;

a cradle fixed to the lower end of the rod, projecting transversely therefrom, and adapted to carry the body of the instrument with the neck thereof projecting upward;

a pair of arms pivotal on the element above the cradle between an open position spaced from each other sufficiently that the neck can pass between them and a closed position engaging around and securing the neck of the instrument in the cradle against significant movement relative to the mounting element;

a rod pivot on the rod connected to the arms such that downward movement of the rod from the upper rest position pivots the arms toward the closed position and upward movement of the rod from the lower working position pivots the arms toward the open position; and a spring braced between the mounting element and the rod and urging the rod with a predetermined force into the upper rest position and the arms into the closed position, the force being substantially less than a weight of the instrument.

15. The mount defined in claim 14, wherein the pivot between the arms and the rod defines a central pivot axis generally perpendicular to the rod.

16. The mount defined in claim 15, wherein the arms are pivoted on the element about respective side pivot axes flanking and generally parallel to the central pivot axes, whereby the arms pivot in a plane generally including a longitudinal axis of the rod.

17. The mount defined in claim 14, further comprising:

links each having one end pivoted on a respective one of the arms and an opposite end pivoted on the rod pivot.

18. The mount defined in claim 14, wherein the rod pivot carries both of the arms for pivoting about the central pivot axis, the mount further comprising:

links each having one end pivoted on the mounting element and an opposite end pivoted generally centrally on a respective one of the links.

* * * * *